United States Patent [19]

Gugel

[11] 4,438,805

[45] Mar. 27, 1984

[54] MANIPULATOR FOR REMOTE-CONTROLLED INSPECTION AND, IF NECESSARY OR DESIRABLE, REPAIR OF HEAT EXCHANGER TUBES

[75] Inventor: Georg Gugel, Kalchreuth, Fed. Rep. of Germany

[73] Assignee: Kraftwerk Union Aktiengesellschaft, Mülheim, Fed. Rep. of Germany

[21] Appl. No.: 289,153

[22] Filed: Aug. 3, 1981

[30] Foreign Application Priority Data

Aug. 6, 1980 [DE] Fed. Rep. of Germany ..... 3029811

[51] Int. Cl.[3] ..... F28G 15/02

[52] U.S. Cl. ..... 165/76; 165/11 A; 29/402.01; 414/744 R

[58] Field of Search ..... 165/11 A, 76; 29/402.01; 73/40.5 R; 376/250; 414/744 R, 749

[56] References Cited

U.S. PATENT DOCUMENTS

| | | | |
|---|---|---|---|
| 3,934,731 | 1/1976 | Müller et al. | 376/250 |
| 4,018,346 | 4/1977 | Leshem et al. | 165/11 A |
| 4,070,561 | 1/1978 | Shunichi et al. | 165/11 A |
| 4,193,735 | 3/1980 | Savor et al. | 414/744 R |
| 4,200,424 | 4/1980 | Gerkey et al. | 414/744 R |
| 4,205,940 | 6/1980 | Golick | 165/11 A |
| 4,213,732 | 7/1980 | Cooper, Jr. | 29/402.01 |

FOREIGN PATENT DOCUMENTS

| | | | |
|---|---|---|---|
| EP8386 | 3/1980 | European Pat. Off. | 165/11 A |
| 2552341 | 6/1976 | Fed. Rep. of Germany | 165/11 A |

*Primary Examiner*—William R. Cline
*Assistant Examiner*—John M. Kramer
*Attorney, Agent, or Firm*—Herbert L. Lerner; Laurence A. Greenberg

[57] ABSTRACT

Manipulator for positioning a tube probe at tube mouths of heat-exchanger tubes by remote-control of the tube probe which is connected to a flexible supply line for inspecting and/or repairing the heat-exchanger tubes, the tube mouths being disposed in a tube sheet and extending over an approximately semicircular tube field defined by a chord, includes at least three clamping devices distributed over the length of a carrying body fixed to the tube sheet and being lockable independently of one another in respective tube mouths of the tube sheet, the clamping devices being formed as insertable and retractable expanding mandrels extending from the carrying body towards and spacing the carrying body from the tube sheet, a boom having a swivel head by which it is fastened to a rotary shaft of a swing drive seated on the bearing surface of a support facing towards the tube sheet, a mouthpiece disposed at a free end of the boom and spaced from the rotary shaft a distance greater than a perpendicular distance of the rotary shaft from the chord defining the approximately semicircular tube field, the mouthpiece being thereby pivotable with the boom into the space between the carrying body and the tube sheet for introducing the tube probe into the respective tube mouths located thereat.

5 Claims, 4 Drawing Figures

MANIPULATOR FOR REMOTE-CONTROLLED INSPECTION AND, IF NECESSARY OR DESIRABLE, REPAIR OF HEAT EXCHANGER TUBES

The invention relates to a manipulator for the remote-controlled positioning of tube probes serving for tube inspection and, if necessary or desirable, tube repair.

Such a manipulator is known from U.S. Pat. No. 3,934,731. In this known manipulator, the carrying body, called an equipment carrier therein, covers up the tube mouths lying within its base area. Consequently, access to the covered tube mouths cannot be gained without repositioning the carrying body.

Another known manipulator of the above-described kind, according to German Published, Non-Prosecuted Application DE-OS No. 25 52 341, operates by the so-called fingerwalker principle. In principle, such a fingerwalker includes two parts, being movable relative to each other and sliding in each other, each part having its own expanding mandrels which must suffice to lock the entire manipulator to the tube field so that the other part, with its expanding mandrels released, can move or be stepped forward and, after its expanding mandrels are locked again upon completion of the step, the other manipulator part can execute a step, and so on.

In the above-mentioned known manipulator according to German Application DE-OS No. 25 52 341, the two manipulator parts include two arms, which are disposed at right angles to each other and are movable in the X or Y direction of an imaginary coordinate system relative to each other and hence, also to the tube field, each arm being equipped with expanding mandrels as its end. Such a fingerwalker is a structure of relatively complicated construction which must contain not only the local control for the boom carrying the mouthpiece, but also the propulsion control for the stepping mechanism.

It is accordingly an object of the invention to provide a manipulator for remote-controlled inspection and, if necessary or desirable, repair of heat exchanger tubes, which overcomes the hereinafore-mentioned disadvantages of the heretofore-known devices of this general type, and with which a 100% inspection of the tube field of a heat exchanger, especially within the primary chamber of a steam generator for nuclear reactors, is made possible without the need for repositioning the manipulator once fastened, and without having to comprise the mechanism and control of a fingerwalker.

With the foregoing and other objects in view there is provided, in accordance with the invention, a manipulator for the remote-controlled positioning of tube probes connected to flexible supply lines for inspection and, if necessary or desirable, repair of heat exchanger tubes, in particular steam generator tubes for nuclear reactors, being disposed in a field and having mouths and being set in a tube sheet along a given plane, comprising a carrying body, a track disposed on the carrying body, at least three mutually spaced-apart insertable and retractable expanding mandrels distributed over the length of the carrying body for attaching the carrying body within the tube mouths, a support being mounted to the carrying body and movable in a straight direction along the track, a boom being mounted to the support for swinging at a pivot point in a plane transverse to the given plane, the boom having a free end, a mouthpiece being supported on the free end and being movable into alignment with or attachment to a respectively selected tube mouth, a chord limiting the tube field, a flexible guide tube being connected to the mouthpiece and enclosing the supply lines for adjustable lengthwise motion and for driving a tube probe into a tube, the boom being swingable in an angular range of at least $360° - 2\alpha$, where $\alpha$ is defined by the relation $\cos \alpha = m/n$, n being the length of the boom and m being the length of a perpendicular from the boom pivot point to the tube-field limiting chord, at least one or one each of the mandrels being retractable for allowing a tube mouth in which it is inserted to become accessible to the mouthpiece and/or for allowing one of swinging or lengthwise adjustment of the boom which would otherwise be interfered with by the at least one mandrel while the others of the expanding mandrels remain engaged.

In accordance with another feature of the invention, the boom is adjustable in length.

In accordance with a further feature of the invention, the boom is a telescopic boom with a telescopic linkage.

In accordance with an added feature of the invention, the at least three mandrels are four expanding mandrels evenly distributed over the length of the carrying body.

In accordance with a concomitant feature of the invention, the heat exchanger tubes are U-tubes of a steam generator having a primary chamber, an arched wall separating the chamber into two primary chamber halves, and there is provided a bracing device being disposed on the carrying body and having at least one supporting foot being operable to be laterally braced against the separating wall.

The advantages attainable by the invention are seen primarily in that the manipulator, once fastened to and centered in the tube field by means of the expanding mandrels of its carrying body, neither has to be repositioned any more for a 100% tube inspection, nor does it have to be stepped; the straight motion of the support and the stepless swinging motion of the boom suffice to cover all tube endings. Therefore, the expanding mandrels are not retracted for propulsion, but only to make a swinging or lengthwise motion of the boom possible in this area and/or access to the tube mouth occupied by the expanding mandrel; once the manipulator is positioned and centered, it stays there.

Other features which are considered as characteristic for the invention are set forth in the appended claims.

Although the invention is illustrated and described herein as embodied in a manipulator for remote-controlled inspection and, if necessary or desirable, repair of heat exchanger tubes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
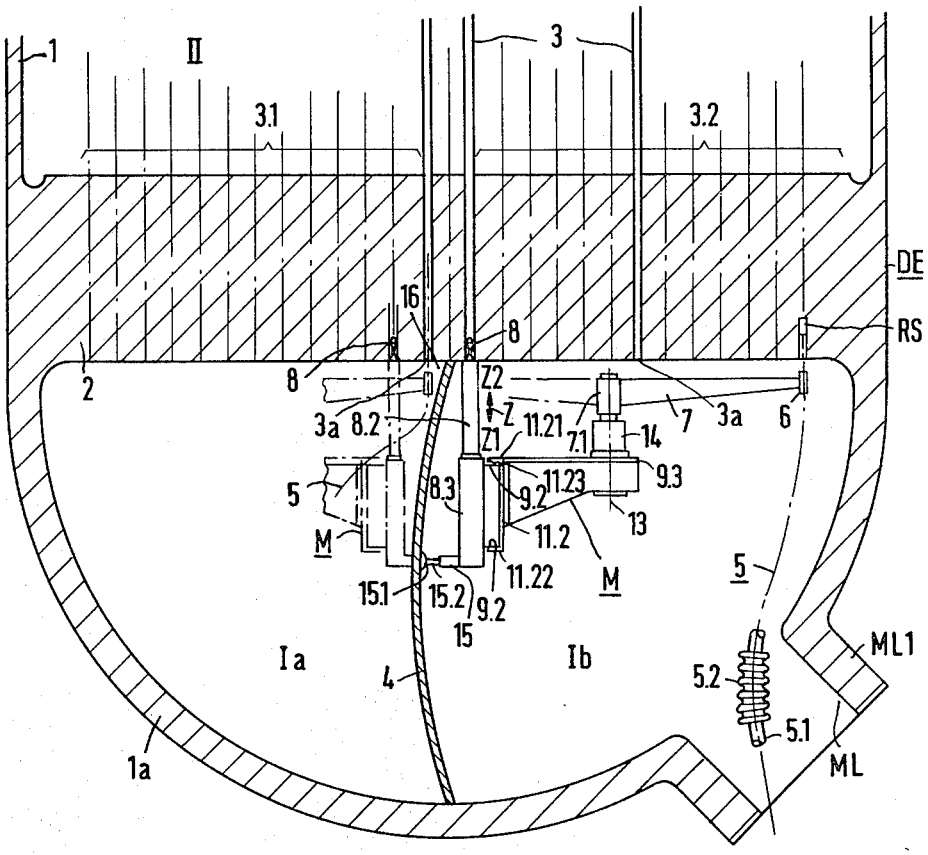
FIG. 1 is a fragmentary, diagrammatic longitudinal-sectional view of a steam generator, showing the side view of the manipulator fastened to and centered in the tube bottom in the one primary chamber half.

Referring now to the figures of the drawing in which components that are unnecessary for understanding the device have been omitted, and first particularly to FIG. 1 thereof, there is seen a steam generator DE for pressurized-water nuclear reactors, which has a boiler wall 1 with a welded-in tube sheet 2 and a bottom cup wall part 1*a* for the two primary chamber halves Ia, Ib. Welded into the tube sheet 2 are the heat exchanger tubes 3. Only three of the tubes 3 are drawn in full while the others are merely indicated by broken lines, and tube mouths 3*a* pointing to the primary chamber Ia, Ib are also indicated. The primary medium, processed regular water heated in a core of a non-illustrated reactor pressure vessel, flows into the primary chamber half Ia, such as through a likewise non-illustrated primary loop line and a non-visible inlet nipple, the primary chamber half Ia being separated from the primary chamber half Ib by an arched separating wall 4. The medium enters the cluster of tubes 3.1 through the mouths 3*a*, gives off its heat to the secondary medium which is contained in the secondary chamber II and is to be evaporated, and flows through U-tube bends into the second tube cluster 3.2, which it leaves through the tube mouths 3*a* so that it can be fed back into the primary chamber half Ib and through the non-illustrated outlet nipple of the latter into the primary loop, to be heated anew in the reactor core. The heat-exchanging tubes 3 of the steam generator DE must undergo a periodic inspection for incipient cracks. This is done by means of a tube probe RS of an eddy current measuring instrument which can be driven into the tubes 3 and is shown in FIG. 1 in an inserted position in the tube mouth area. Besides the eddy current measuring probe RS, this may also involve cleaning tools for cleaning the tube interior, or repair tools through which explosive plugs to seal cracks can also be brought in.

A manipulator M serves to manipulate all these probes. The manipulator M consequently serves for the remote-controlled positioning of tube probes RS for inspection, and if necessary or desirable, for repair, at the tube mouths 3*a* of the tubes 3 of steam generators DE for nuclear reactors, the tubes being set in the tube plate 2. Instead of steam generators, this could also involve generally heat exchangers having a corresponding tube plate or sheet 2. The probe RS is connected to a flexible supply line 5.1, simultaneously serving as a feed tube for the tube probe RS at the end thereof, and being disposed within a flexible guide tube 5.2 so as to be movable back and forth. A section of the supply and guide tubes 5.1, 5.2 is shown in an enlarged form in FIG. 1, and indicated with reference numeral 5 as a whole. The guide tube 5.2 ends in a mouthpiece 6 which is supported by the free end of a boom 7 that is mounted in such a way that it can swing in a plane transverse to the tubes.

Figure 2:
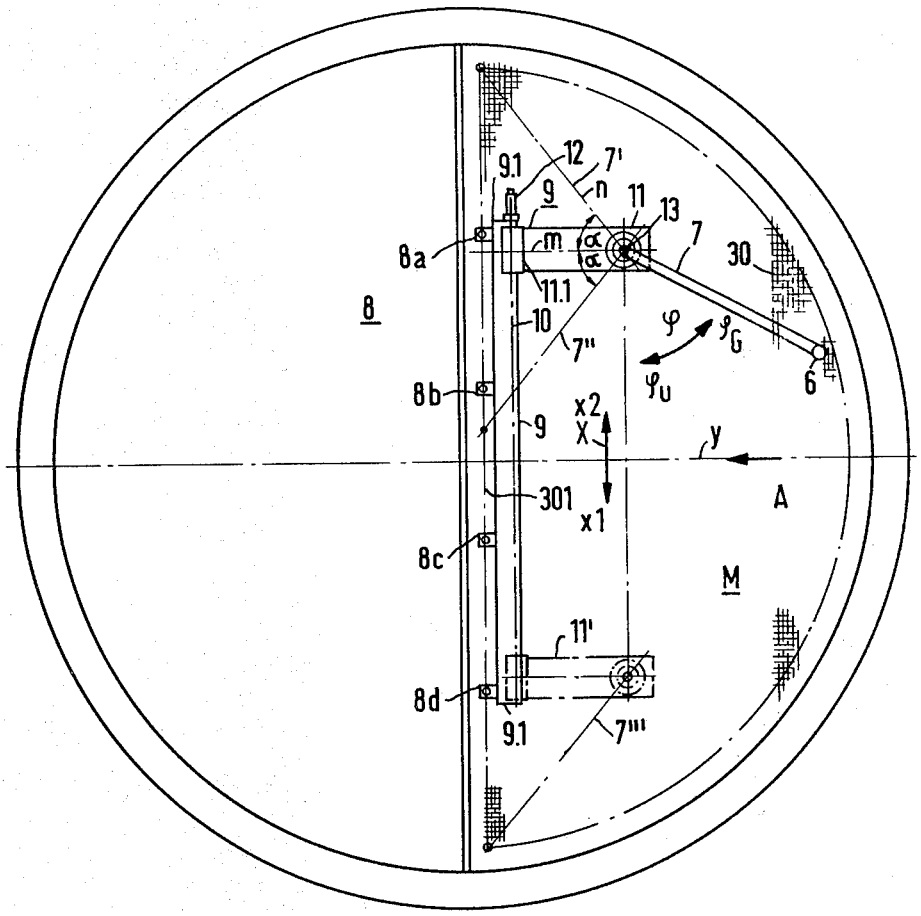
FIG. 2 is a bottom plan view of the manipulator according to FIG. 1, four boom positions and two support positions being shown.
Figure 3:
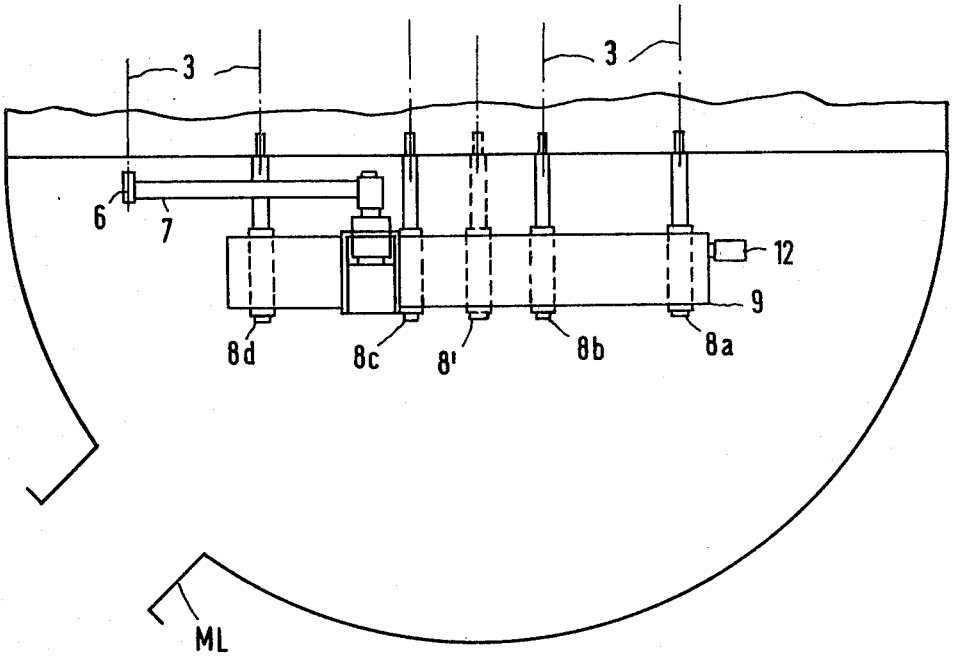
FIG. 3 is a fragmentary elevational view of the manipulator according to FIG. 2, taken along the direction of the arrow A.

It is shown in FIG. 1 in conjunction with FIGS. 2 and 3, that the manipulator M has: a carrying body 9 with a track 10 in the form of a spindle, the carrying body 9 being attachable to the tube mouths 3*a* by means of mutually spaced-apart expanding mandrels 8; a support 11, mounted to, and movable in a straight line in the x-direction along the track 10 of the carrying body 9; and the already mentioned boom 7, mounted to the support 11 so as to pivot in a plane transverse to the tubes. The carrying body 9 includes a long frame structure with end plates 9.1 equipped with bearings for the rotation of the two ends of the externally threaded spindle 10. A drive motor 12 for the spindle 10 is also attached to a flange of one of the plates 9.1. The support 11 is a stiff cantilever beam, having a travelling nut part 11.1 that is mounted on the spindle 10, so that, when the spindle 10 turns, the support can be moved back and forth in the x-direction depending on the direction of rotation, but cannot corotate. For this purpose, a U-shaped shackle 11.2 of the support 11, with upper and lower holding arm 11.21, 11.22, correspondingly engages upper and lower guideways 9.2 of the carrying body 9. The bent end 11.23 of the upper guide arm 11.21 grips behind a non-illustrated guide strip, of the carrying body 9, and makes certain that the support 11 cannot flip down. All guide surfaces on the support 11 and their countersurfaces on the carrying body 9 for the motion of the support in the x-direction shown in FIG. 2 may be provided with non-illustrated rolling parts to obtain a rolling instead of a sliding friction.

A housing of a swing drive 14 is attached to a flange of an upper bearing surface 9.3 at the free end of the support 11. The housing of the swing drive 14 has an axis of rotation which is vertical in the operating position of the manipulator M and which involves an infinitely variable turning motor, having a rotating shaft 13 connected to the mounting part 7.1 of the boom 7, serving as a swivel head. The lengthwise extent of the carrying body 9, support 11 and boom 7 are each such that by moving the support 11 in the x-direction and by swinging the boom 7 through the angle $\phi$ in an angular range of at least $360° - 2\alpha$, as will be explained later in detail, any tube mouth 3*a* of the tube field 30 can be reached by the mouthpiece 6 of the boom 7 (best seen in FIG. 2). A portion of the tube field 30 is indicated in FIG. 2 by a grid of perpendicularly intersecting lines and by the dot-dash contour lines of a circular segment.

The expanding mandrels 8 are inserted and retracted (as seen in FIG. 1 in particular) by means of expanding mandrel drives including a push rod 8.2 supporting the expanding mandrel 8 at its free end and a drive housing 8.3 for the push rod 8.2. The housing may be constructed as a pneumatic cylinder for the push rods 8.2 having appropriate non-illustrated pneumatic pistons. In the operating position of the manipulator shown, the expanding mandrels 8 are inserted and retracted in the z-direction as indicated by the arrow in FIG. 1. Construction and operation of such expanding mandrels are known and are described in detail in German Published, Non-Prosecuted Application DE-OS No. 25 52 341, for instance, so that a more explicit explanation is unnecessary here.

FIGS. 2 and 3 show that there are at least three (in the present case there being four) insertable and retractable expanding mandrels 8, distributed over the length of the carrying body 9. By way of the boom positions 7, 7', 7'' and 7''', FIG. 2 makes it further clear that the boom 7 can be swung continuously in an angular range of $360° - 2\alpha$, so that the mouthpiece 6 can be aligned with any tube mouth 3*a* and the tube probe RS can thus be driven-in without a problem. In addition, the insertion end of the tube probe RS is expediently tapered to facilitate entry in case of small lateral deviations. The angle $\alpha$ is defined by the relation $\cos \alpha = m/n$, where n is the length of the boom 7 and m is the perpendicular from the boom pivot point 13 to the tube-field limiting chord 301. This becomes clearer by viewing FIG. 2 and the boom positions 7, 7'', 7''' and 7'. From the boom position 7 shown in solid lines, the boom can be moved into the position 7'' by pivoting it in the clockwise direction $\phi\mu$. It thus reaches the tube-field limiting chord 301 and the tube mouths located on this chord. By then driving the support 11 in the xl-direction shown, all tube mouths located in this direction up to the extreme position 7''' can be reached by the mouthpiece 6, except for the tube mouths occupied by the expanding mandrels 8*c* and 8*d*. For this reason the expanding mandrels are briefly retracted in the zl-direction shown in FIG. 1 when the boom mouthpiece 6 is a short distance away from the tube mouth covered by the expanding mandrels 8*c*, 8*d*, respectively, during which proces the other expanding mandrels 8*a*, 8*b* and 8*d* (in the case of the lifted expanding mandrel 8*c*) remain engaged. The fastened and centered position of the manipulator M or carrying body 9 thus is preserved. The same applies when approaching the tube mouth covered by the expanding mandrel 8*d*; the latter is disengaged to inspect the respective heat exchanger tube while the others, 8*a*, 8*b* and 8*c*, remain engaged. If the rest of the tube mouths located on the limiting chord 301 are to be approached, the boom 7 must be swung into the position 7' which requires bringing it into its center position, i.e. moving the support 11 so that the pivot point lies on the axis of symmetry y. It is then possible to swing the boom in a counterclockwise direction $\phi_G$ into the position 7'. When approaching the tube mouths on the limiting chord 301 which can then be reached, the expanding mandrel 8*a* is retracted briefly, as already fundamentally explained, so that the boom can first be moved further and so that second, the tube which was blocked by the expanding mandrel can also be inspected. As may be seen, due to appropriate adjusting operations, the mouthpiece 6 of the boom 7 reaches all tube mouths 3*a* of the tube field 30, regardless of whether the tube field is based on a Cartesian or a polar system of coordinates. For acknowledgement of the respective position of the boom 7, an angle encoder is associated with its turning motor 14, and the support 11 may be in engagement, for instance, with the pinion of a length encoder having a rack disposed parallel to the spindle 10 on the carrying body 9. In this way a computer in a control console can compute the exact tube position in Cartesian coordinates occupied by the mouthpiece 6 at the time, from the respective pulses of the length and angle encoders. As may be seen, the manipulator M is positioned symmetrically to the axis of symmetry y, and the length of the boom 7 is also adjusted to this position. The electrical leads connected to the positioning motors 12 and 14, the length and angle encoders and the pneumatic supply lines for the expanding-mandrel cylinders 8.3, have been omitted for the sake of simplicity.

In FIG. 3, broken lines indicate an expanding mandrel 8' which could be used in a second embodiment in place of the two expanding mandrels 8*c* and 8*b*, so that the manipulator M would be equipped with the expanding mandrels 8*a*, 8' and 8*d*. Three expanding mandrels represent the minimum per manipulator because, in the inspection position of the manipulator M, two of them must always be engaged. Increased clamping safety, however, is provided by the first embodiment with four expanding mandrels because if one of the at least three simultaneously engaged expanding mandrels should fail, two of them are still engaged.

It is also possible to provide more than four expanding mandrels.

Figure 4:
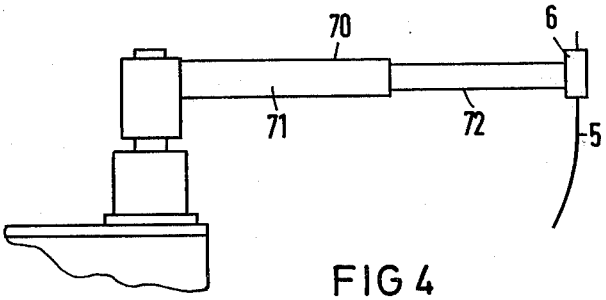
FIG. 4 is a fragmentary detailed elevational view of a manipulator boom variant with telescopic adjustment.

FIG. 4 shows, in a cutaway portion, a boom 70 having a length that is adjustable by a telescopic linkage with a cylinder part 71 and a piston part 72. Such a boom can be shortened by almost half its length which, for instance, has the advantage that the boom need not be moved to its center position for swinging it from position 7 to position 7', as shown in FIG. 2. Moreover, this also makes it possible to achieve an advantage that the boom length and the dimensions of the support 11 and of the carrying body 9 need not conform so exactly to the inside contours of the steam generator chamber; this would make such a manipulator more universal, i.e. applicable to different steam generator sizes with different primary chamber dimensions.

In addition to the expanding mandrels, the manipulator M can be braced even better and in a more vibration-resistant manner in the primary chamber half Ib by providing the carrying body 9 with a bracing device 15 having at least one supporting foot 15.1 which can be braced against the separating wall 4. This advantageously involves a pneumatic piston/cylinder arrangement. The supporting foot 15.1 is linked by a ball joint to the piston rod 15.2 to adapt to the arch radius of the separating wall 4.

The dot-dash fragmentary view of the manipulator M in the left half of FIG. 1 within the primary chamber half Ia makes it clear that it is possible to drive the mouthpiece 6 even into the acute-angled niches 16 brought about by the convexity of the separating wall 4, which however puts special requirements on the flexibility of the guide and supply line 5.2, 5.1.

In the case of a straight-tube steam generator, the primary chamber of the steam generator is not divided by a separating wall 4; it would be advantageous in this case to use a manipulator M which should be imagined to have come about by doubling, i.e. mirroring along its expanding-mandrel connecting axis and therefore having one support 11 with the boom 7 on each side of the longitudinal axis of a carrying body 9 doubled in this manner. In this case, both swinging arms could even operate at the same time, whereby in comparison to a manipulator with only one boom, the inspection time would be about halved.

The manipulator M is introduced into the drained primary chamber of the steam generator through the manhole ML (having a non-illustrated cover that is removed for this purpose) and is brought into the inspection position, best seen in FIG. 2. This requires only a short stay of the operating personnel in protective suits in the primary chamber. After completion of the inspection, the manipulator M is dismounted and taken out in the same way. Basically, it is also possible, in order to make it unnecessary for the personnel to enter the primary chamber of the steam generator, to fasten a rail system to the manhole nipple ML 1. The rail system extends from the outside through the nipple into the primary chamber interior, and the manipulator is placed on the rails on the outside, to then be run to its inspection position by remote control, as already explained in German Published Non-Prosecuted Application DE-OS No. 28 30 306.

There is claimed:

1. Manipulator for positioning a tube probe at tube mouths of heat-exchanger tubes by remote-control of the tube probe which is connected to a flexible supply line and provided for inspecting and/or repairing the heat-exchanger tubes, the tube mouths being disposed in a tube sheet and extending over an approximately semicircular tube field defined by a chord, the manipulator including a rigid carrying body disposed parallel to the tube sheet, the carrying body having a linear track, a support disposed parallel to the tube sheet and mounted on the carrying body so as to extend away therefrom in the direction of the tube sheet, said support being displaceably mounted on the track along the carrying body, a boom mounted on a bearing surface of the support facing towards the tube sheet, the boom being pivotable in a plane parallel to the tube sheet, and a mouthpiece disposed at a free end of the boom and being movable therewith for introducing a tube probe into a respective heat-exchanger tube, said carrying body comprising at least three clamping devices distributed over the length of the carrying body and being lockable independently of one another in respective tube mouths of the tube sheet, said clamping devices being formed as insertable and retractable expanding mandrels extending from the carrying body towards and spacing the body from the tube sheet, the boom having a swivel head by which it is fastened to a rotary shaft of a swing drive seated on the bearing surface of the support facing towards the tube sheet, the mouthpiece being spaced from said rotary shaft a distance greater than a perpendicular distance of said rotary shaft from the chord defining the approximately semicircular tube field, the mouthpiece being thereby pivotable with the boom into the space between the carrying body and the tube sheet for introducing the tube probe into the respective tube mouths located thereat.

2. Manipulator according to claim 1, wherein said boom is adjustable in length.

3. Manipulator according to claim 2, wherein said boom is a telescopic boom with a telescopic linkage.

4. Manipulator according to claim 1, wherein said at least three mandrels are four expanding mandrels evenly distributed over the length of said carrying body.

5. Manipulator according to claim 1, wherein the heat exchanger tubes are U-tubes of a steam generator having a primary chamber, an arched wall separating said chamber into two primary chamber halves, and including a bracing device being disposed on said carrying body and having at least one supporting foot being operable to be laterally braced against the separating wall.

* * * * *